United States Patent [19]

Shimoda

[11] 3,936,623

[45] Feb. 3, 1976

[54] MULTIPLE CONTACT ROTARY SWITCH OF HELICAL CONFIGURATION

[76] Inventor: Eitaro Shimoda, 4-7-1, Matsubara, Setagaya, Tokyo, Japan

[22] Filed: Sept. 11, 1974

[21] Appl. No.: 504,979

[30] Foreign Application Priority Data

| | | |
|---|---|---|
| Sept. 29, 1973 | Japan | 48-109647 |
| Nov. 8, 1973 | Japan | 48-129338[U] |
| Jan. 24, 1974 | Japan | 49-10659[U] |
| Feb. 26, 1974 | Japan | 49-23048[U] |

[52] U.S. Cl. ..... 200/158; 200/4; 200/11 B; 200/11 DA; 200/14

[51] Int. Cl.[2] ..... H01H 3/40; H01H 19/54

[58] Field of Search ..... 200/4, 11 B, 14, 158; 336/139–141, 231; 338/143–149

[56] References Cited

UNITED STATES PATENTS

| | | | |
|---|---|---|---|
| 1,606,153 | 11/1926 | Douglas | 200/158 UX |
| 1,845,406 | 2/1932 | Gebhard | 336/141 X |
| 2,163,644 | 6/1939 | Ware | 336/141 X |
| 2,423,054 | 6/1947 | Strickland, Jr. | 336/231 X |
| 2,472,230 | 6/1949 | Reinschmidt, Jr. | 200/4 X |
| 2,874,237 | 2/1959 | Shlesinger, Jr. | 200/158 X |
| 3,025,361 | 3/1962 | Hartsock et al. | 200/11 B |
| 3,057,014 | 10/1962 | Kirch | 338/148 X |
| 3,088,084 | 4/1963 | Lock | 336/139 X |
| 3,156,888 | 11/1964 | Blanco | 336/139 X |

*Primary Examiner*—James R. Scott
*Attorney, Agent, or Firm*—Hill, Gross, Simpson, Van Santen, Steadman, Chiara & Simpson

[57] ABSTRACT

A helical rotary switch having a helical coil formed of an insulating band like plate, a plurality of contact segments attached to said helical coil, a shaft for said helical coil rotatably supported by a pair of panels, a supporting member supported by said panels and supporting said helical coil between said pair of panels, and a sliding member with contact members engageable with said helical coil and said contact segments. The sliding member is mounted on said shaft such that when the shaft is rotated, said contact members of said sliding member successively contact the plurality of contact segments attached to said helical coil.

9 Claims, 18 Drawing Figures

MULTIPLE CONTACT ROTARY SWITCH OF HELICAL CONFIGURATION

BACKGROUND OF THE INVENTION

1. Field of the Invention

This invention relates to a helical rotary switch having a contact segment mounting plate in the form of a band-shaped coil.

2. Description of the Prior Art

Rotary switches are known to be used for selecting, switching or like operations of electrical circuits. However, the number of contacts of the conventional rotary switches is limited on wafer switches and the largest number of contacts of the rotary switches now on the market is twelve or so. The reason is that since contacts are required to be disposed to cover an angular range of 360° through which a shaft is rotated, the withstand voltage or dielectric strength, insulation and current capacity between adjacent contacts naturally imposes a limitation on the number of contacts.

SUMMARY OF THE INVENTION

This invention has for its object to provide a novel and simple helical rotary switch which is free from the above defects of the prior art.

The other objects, features and advantages of the invention will become apparent from the following description taken in conjunction with the accompanying drawing.

DESCRIPTION OF THE PREFERRED EMBODIMENTS

Figure 1:
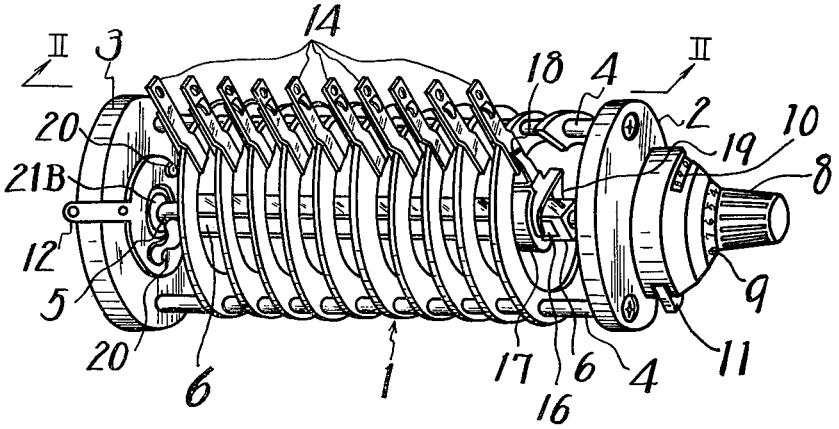
FIG. 1 is a perspective view of an embodiment of the helical rotary switch according to the invention.

FIG. 1 is a perspective view schematically showing the external appearance of one embodiment of this invention. In FIG. 1, contact segment mounting plate 1 is in the form of a band-shaped coil (hereinafter referred to a band-shaped coil) which is a fundamental component of this invention. The band-shaped coil 1 is an insulator formed, for example, of stiff synthetic resin, and formed by cutting or molding to have a desired number of coil members at a desired pitch. In the illustrated example, the band-shaped coil 1 is disposed between disc-shaped panels 2 and 3 formed of an insulator, with the panels being held coaxially, and the panels 2 and 3 are coupled by rods 4 with each other at their peripheral, diametrically opposite positions in such a manner that the band-shaped coil 1 is supported by the rods 4 at its peripheral portion.

Various supporting structures can be employed and the requirements therefore are only to maintain the pitch of the individual coil turns of the band-shaped coil 1 as desired and to rigidly support the band-shaped coil 1 and the panels 2 and 3 as a unitary structure. In the present example, the rods 4 each have formed therein grooves at regular intervals and the coil turns of the band-shaped coil 1 each have formed in the periphery thereof arc-shaped recesses for engagement with the grooves of the rods 4 (refer to FIG. 3).

In FIG. 1, a shaft 5 is supported by the panels 2 and 3 centrally thereof and an insulating guide 6 having a polygonal, for example, square section, is disposed between the panels 2 and 3 to cover the shaft 5. On the insulating guide 6, a slide member described later on is mounted and a contact is secured to the sliding member. A plurality of contact segments 14 are mounted on each coil turn of the band-shaped coil 1 in a manner so they are spaced apart from adjacent segments at desired angular distances. By rotating the shaft 5, the contact on the slide member is moved helically along the coil turns of the band-shaped coil 1.

The shaft 5 may be driven by a solenoid stepper, a step motor or the like in some cases but, in this example, a dial 7 is provided on the side of the panel 2 and the shaft 5 is manually driven with a knob 8 of the dial 7. A rotary scale 9 and a scale 10 show the position of the knob 8. A shaft clamp knob 11 is also provided. On the inside of the panel 3, there is mounted by suitable means a terminal plate 12 which is electrically connected by slide contact 20 to slide contact 18 as shown.

Figure 2:
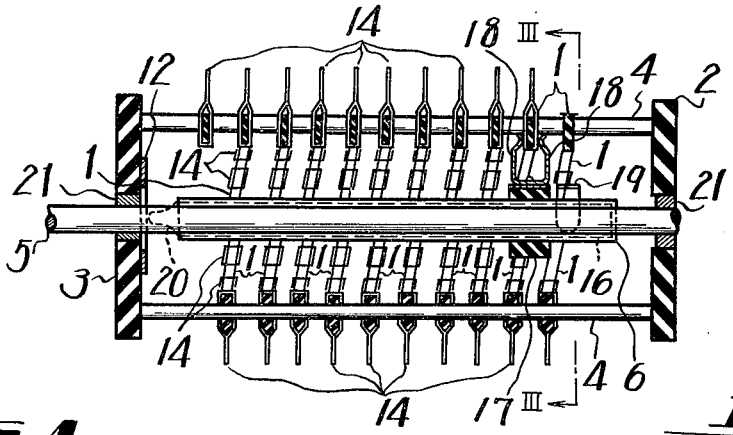
FIG. 2 is a longitudinal sectional view of the principal part of embodiment shown in FIG. 1.
Figure 3:
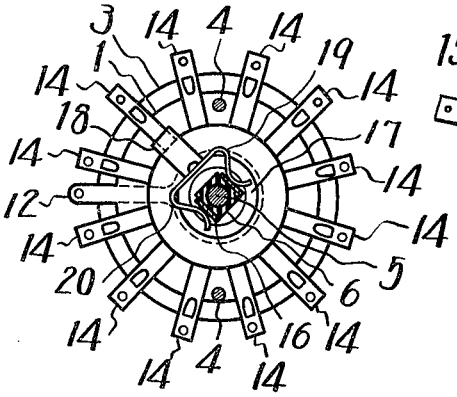
FIG. 3 is a cross-sectional view taken on the line III — III in FIG. 2.

FIG. 2 is a longitudinal-sectional view, for explaining the construction of the principal part of the helical rotary switch of this invention and FIG. 3 is a cross-sectional view taken on the line III—III in FIG. 2. In FIGS. 2 and 3, parts corresponding to those in FIG. 1 are identified by the same reference numerals.

Figure 4:
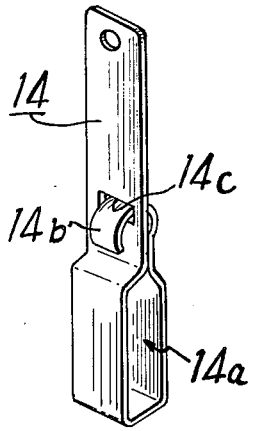
FIG. 4 is an enlarged perspective view showing a contact segment shown in FIGS. 2 and 3.

A description will be first given of the manner in which the contact segments 14 are mounted on the band-shaped coil 1. As illustrated in FIG. 3, each coil turn of the bandshaped coil 1 is divided into twelve equiangular turns (only one part being shown) and recesses 13 are formed in the outer and inner peripheries of each coil turn on the dividing lines and contact segments 14 are mounted on the coil member at the recesses 13. The contact segments 14 are formed of strips of metal and have the shape shown in FIG. 4. When the contact segments 14 are mounted on the coil member, it is bent to have a portion 14*a* surrounding the aforementioned recessed portions of the coil member. A tongue 14*b* of the surrounding portion 14*a* is inserted into a slit 14*c* formed above the surrounding portion 14*a* and then bent down. Such a contact segment 14 prevents an electrically intermittent transient phenomenon when it makes sliding contact with the contact 18 disposed on the insulating guide 6. However, the contact segments 14 need not always be disposed on each coil turn in such a manner as to be each spaced apart from adjacent ones at an equiangular distance and the number of the contact segments 14 and the method of mounting them on the coil turns can be changed as desired.

Figure 5:
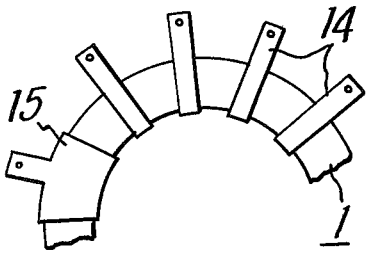
FIG. 5 is a front view of a part of each coil member.

FIG. 5 illustrates a modified form of the example of FIG. 3. In this example, the aforementioned contact segments 14 are mounted together with a number of other contact segments 15 which are, for example, twice as wide as the contact segments 14. This construction is a basic one for producing pulses having various waveform as desired or for sequence control. the wider contact segments 15 are also mounted in the same manner as contacts 14. However, the manner of mounting the contact segments may be by any suitable mounting technique.

In FIGS. 2 and 3, narrow conductive plates 16 are disposed, for example, on a pair of opposing sides of the insulating guide 6, and a slide member 17 is mounted on the insulating guide 6 in a manner so that it is movable only in the axial direction of the guide 6. In this example, the sliding member 17 is circular in shape and has secured to its top a pair of resilient contacts 18 which engage and grip the coil turns of the band-shaped coil 1. A pair of sliding contacts 19 are formed as a unitary structure with the resilient contacts 18 and extend downwardly therefrom. The free end portions of the sliding contacts 19 are urged against the conductive plates 16. At the left-hand end of the insulating guide 6 in the figure, slide contacts 20 are formed and extend radially from the conductive plates 16, for example, and are resiliently urged against the terminal plate 12. The conductive plates 16 having the sliding contacts 20 are formed by pressing and cutting a resilient thin sheet of, for example, phosphor bronze. Suitable bearings are fitted into the panels 2 and 3 to rotatably support.

With the above construction, when the shaft 5 is rotated, the resilient contacts 18 engage the band-shaped coil 1 and are moved in the direction of winding of the band-shaped coil 1 (clockwise or anticlockwise) and the slide member 17 slides on the insulating guide 6. The resilient contact 18 and the terminal plate 12 are electrically connected to each other through contacts 20 plate 16 and member 19. Consequently, it is possible to achieve selection or switching of various electrical circuits connected to the individual contacts 14 mounted on each coil turn of the band-shaped coil 1 and the terminal plate 12. The total number of the contacts 14 is the sum of contacts mounted on the respective coil turns of the band-shaped coil 1. It is also possible to provide a plurality of sliding members 17 which could engage different contacts 14. A plurality of pairs of resilient contacts 18 could also be provided on each sliding member 17.

In the present invention each coil turn of the band-shaped coil corresponds to a unit wafer in prior art rotary switches. Therefore, the total number of contacts is N times larger than that of the conventional rotary switch and can easily be obtained by using a band-shaped coil having an N number of turns. Further, the helical rotary switch of this invention is simple in construction and can be designed so as to be free from danger due to its dielectric strength, insulation and current capacity. Moreover, it can be used for various purposes as described previously and, further, it is also possible to combine a limit switch with the helical rotary switch by making use of the reciprocating motion of the sliding member 17 and to construct a multistep-type rotary switch with a plurality of units each having one band-shaped coil.

Further, the helical rotary switch of this invention can be miniaturized and produced with case, and hence is suitable for mass-production at low cost.

A second embodiment of this invention will now be described.

Figure 6:
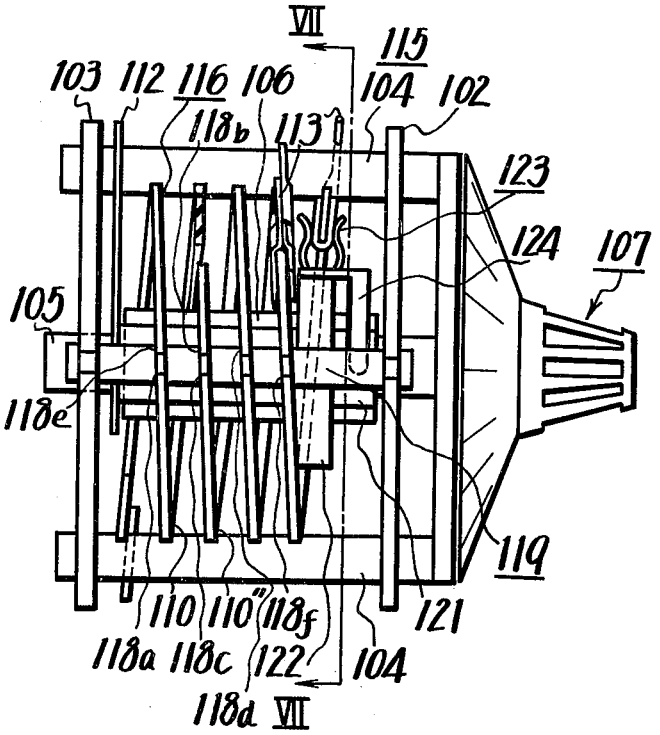
FIG. 6 is a schematic side view of a second embodiment of the invention.

In FIG. 6, a second embodiment of the helical rotary switch 115 of this invention is shown, which comprises a shaft 105 rotatably mounted between, panels 102 and 103, a spiral-shaped coil 116, rods 104, a terminal plate 112, contact segments 113, a dial 107, are arranged substantially the same manner as in the embodiment of FIG. 1.

Figure 8:
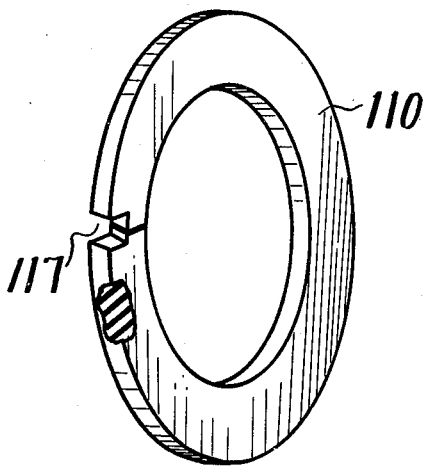
FIGS. 8 and 9 are pespective views used for explaining the coil members used in the second embodiment shown in FIG. 6.
Figure 9:
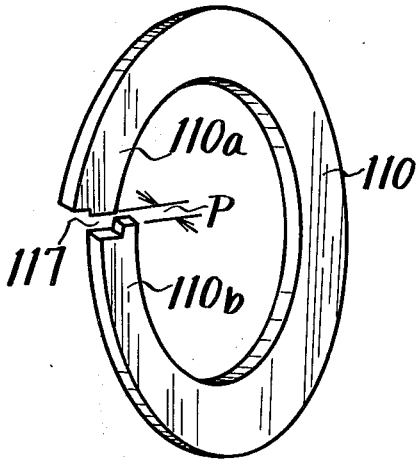

In this embodiment the spiral-shaped coil 116 is formed, by pressing, molding or heating a resinous, ceramic or other electrically insulating material according to its characteristic. An annular unit 110 such as shown in FIG. 8 is formed which has an abutting joint 117 and predetermined outer and inner diameters. Ends 110*a* and 110*b* at the joint 117 are spaced apart from each other in the axial direction of the unit 110 as indicated by P in FIG. 9. In the present example, such a unit 110 is used as a coil member and a plurality of them are sequentially coupled into a unitary structure to form the spiral-shaped coil 116.

Figure 10:
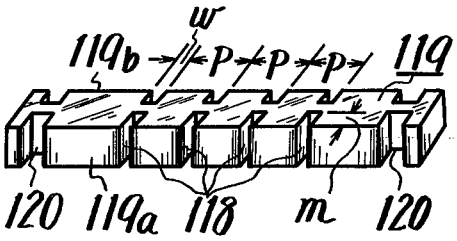
FIG. 10 is a perspective view of a support member for the coil members shown in FIGS. 8 and 9.

FIG. 10 illustrates a support 119 for coupling and supporting the abovedescribed units 110 in a helical form. The support 119 is a bar, which may be, rectangular in section, which is formed to support a desired number of units 110, for example, four units, at a pitch P determined by a pair of opposing sides 119*a* and 119*b* of the bar. The sides 119*a* and 119*b* have formed therein pairs of recesses 118, each having a width *w* corresponding to the thickness of the unit 110 and a depth *m* corresponding to the abutting joint 117. There are two pairs of recesses 120 for attachment of the support 119 to the panels 102 and 103. The recesses 118 are formed obliquely so as to mate with the spiral of the units 110.

The units 110 constructed as described above are assembled together in the following manner. As shown in FIG. 6, one end of a first one of the units 110 is placed into a first recess 118*a* of the support 119 which is secured to the panels 102 and 103 and the other end of the first unit 110 is placed in a second recess 118*b*. Then, one end of a second unit 110″ is placed in a third recess 118*c* of the support 119 and the other end of the second unit 110″ is placed in a fourth recess 118*d*. Thereafter, the units are similarly assembled together to provide the band-shaped coil 116.

Figure 7:
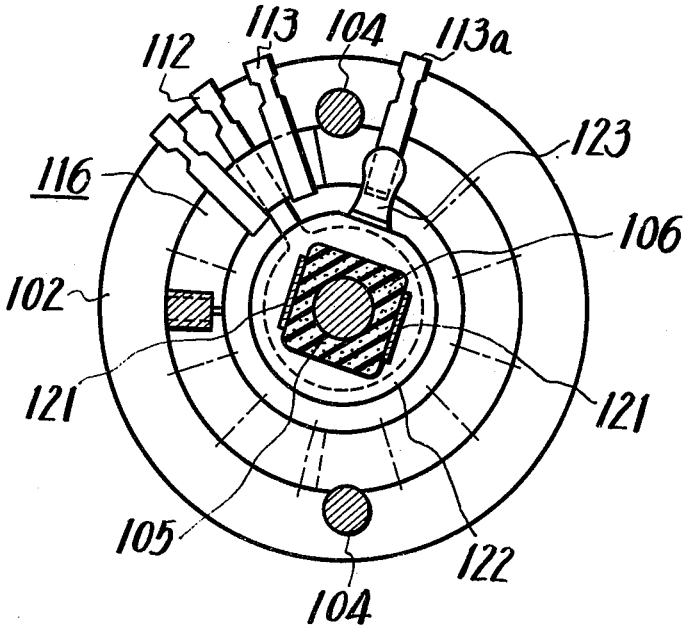
FIG. 7 is a cross-sectional view taken along the line VII — VII in FIG. 6.

In FIG. 7, conductive plates 121 are deposited on a pair of opposing sides of an insulating guide 106 mounted on the shaft 105 to cover it. The conduction plates 121 are each electrically connected at one end with the terminal plate 112 and at the other end, through a sliding contact 124, with pair of resilient contacts 123 having a slide member 122 which is guided by the insulating guide 106 to slide in its axial direction. The resilient contacts 123 are electrically connected with a desired contact segment 113.

As described above, in the second embodiment of this invention, a plurality of annular units each having an abutting joint, which are formed by molding, pressing or heating of an insulator, are assembled together in a helical form to construct the band-shaped coil, so that the fabrication of the band-shaped coil is easy.

Figure 11:
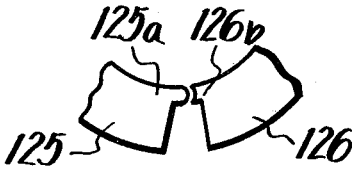
FIG. 11 is a partial view showing an abutting portion of the coil member.

In the above example, the helical band-shaped coil is constructed with the ends of the units butted to each other, but it is also possible to form a rounded projection 125*a* at one end of one unit 125 and a projecting piece 126*b* having an arc-shaped recess at one end of the other unit 126 for receiving the rounded projection 125*a*, as shown in FIG. 11. Other various abutting constructions can also be adopted.

Referring now to FIGS. 12 to 15, a third embodiment of this invention will hereinbelow be described.

Figure 12:
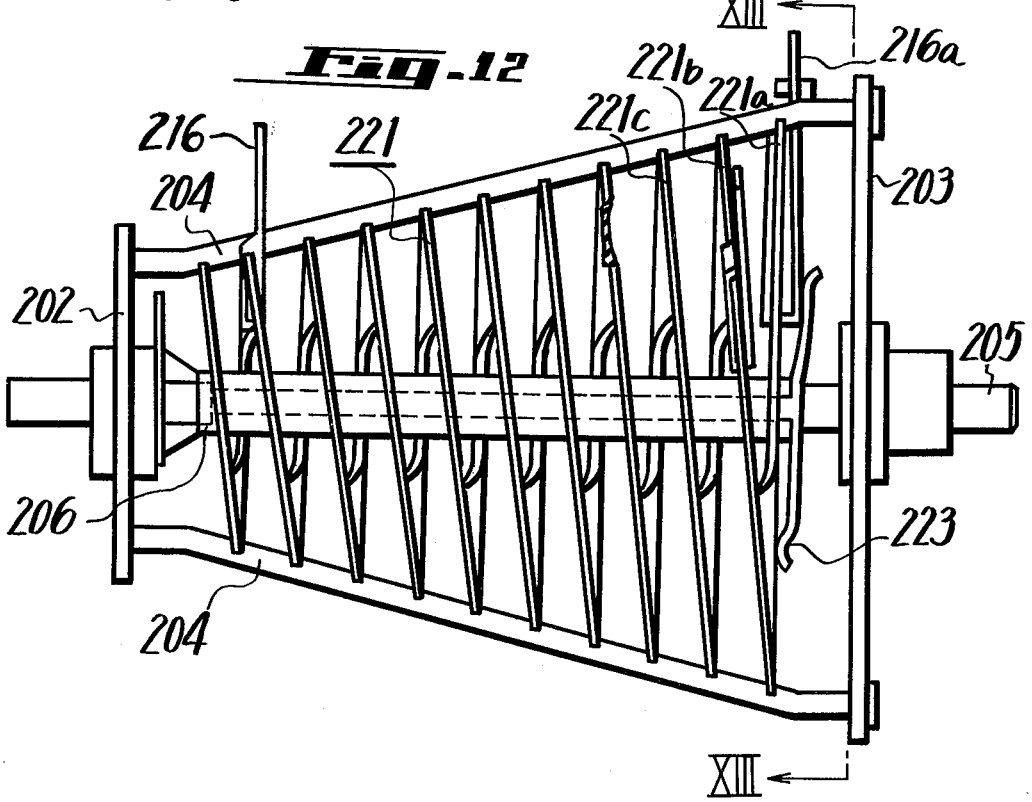
FIG. 12 is a schematic side view of a third embodiment of the invention.
Figure 13:
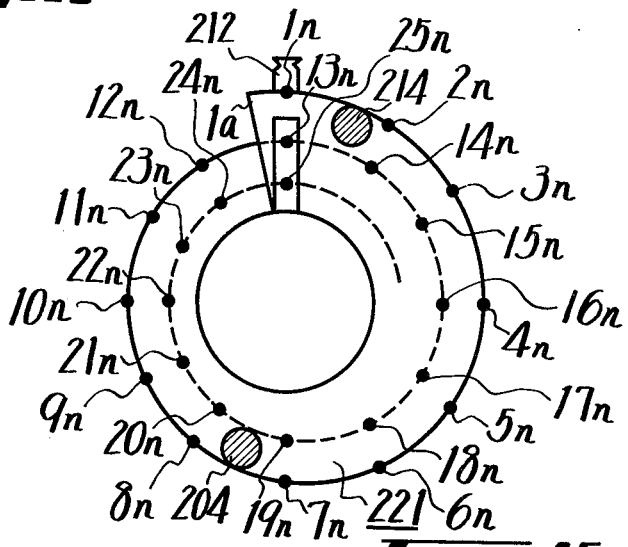
FIG. 13 is a cross-sectional view taken on the line XIII — XIII in FIG. 12.
Figure 14:
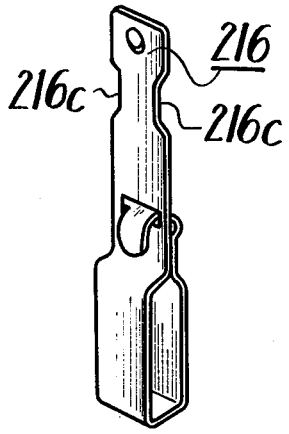
FIG. 14 is an enlarged perspective view of a contact segment used in the third embodiment.

In FIGS. 12 to 15, a shaft 205, is rotatably supported by panels 202 and 203. A spiral-shaped coil 221 which is composed of first, second and third coil turns 221*a*, 221*b* and 221*c* whose outer diameters are sequentially reduced at a constant rate to construct the band-shaped coil 221 in a conical form, as shown. In this case, it is also possible to sequentially increase the outer diameters of the coil members at a constant rate. The coil 221 can be formed of an insulator such as synthetic resin or the like. When 12 contact segments are mounted on each coil turn (360°), they can be positioned on the spiral line. In FIG. 13, reference numeral 1*n* indicates a first contact segment and 2*n* . . . designate other . . . contact segments. In this third embodiment, as shown in FIG. 14, recesses 216*c* are formed in free end portion of a terminal of a contact segment 216 on the both sides thereof for winding thereon an external lead. As in the example of FIG. 4, and, though not shown, a recess is similarly formed in one end portion of the coil 221 for winding thereon an external lead. In this case, it is possible to indicate segment numbers, for example, 1*n*, 2*n*, . . . on the contact segments of the spiral-shaped coil 221.

Figure 15:
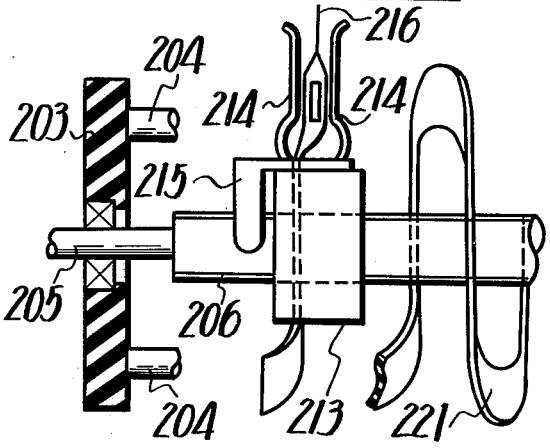
FIG. 15 is a cross-sectional view of the main part of the third embodiment.

In FIG. 12, conductive plates are deposited on a pair of opposing sides of an insulating guide 206 surrounding the shaft 205 and the conductive plates are each electrically connected at one end with a first contact segment 216*a* through a slide member 223. In FIG. 15, a pair of resilient contacts 214 are provided on a sliding contact 215 mounted on a sliding member 213 mounted on the insulated guide 206 and slidable in the axial direction of the shaft 205. The resilient contacts 214 are formed so that they can be electrically connected to the terminal 216 of the contact segment 1*n* provided at the position of the maximum outer diameter of the coil 221. In the third embodiment, for example, in FIG. 13, reference numerals 212 and 204 correspond to the terminal plates 12, 112 and the rods 4, 104 in the foregoing embodiments and their constructions are substantially identical.

A description will be given of the operation of the third embodiment of the above construction.

In FIG. 12, when it is desired to contact the terminal of the contact segment 1*n* disposed at the position corresponding to the maximum outer diameter of the coil 221 with the terminal of a contact segment, for example, 5*n*, the shaft 205 is rotated to bring the resilient contacts 214 mounted on the shaft 205 to the terminal 216 of the contact segment 5*n* disposed on the coil 221. At this time, the terminal 216 of the contact segment 1*n* makes contact with sliding piece 223, which, in turn, makes contact with the conductive plates mounted on the insulating guide 206. The conductive plates make contact with the resilient contacts 214 through the sliding contacts 215, which, in turn, make contact with the terminal 216 of the contact segment 5*n*. Thus, the contact segments 1*n* and 5*n* are electrically connected to each other. In this manner, switching of desired contact segments can be achieved.

As described above, in this third embodiment, the spiral-shaped coil serving as a contact segment mounting plate is provided in a conical form, so that, for example, in the case of soldering leads to the terminals 216 provided on the respective contact segments, the contact segments are arranged in a spiral manner in the axial direction of the shaft and do not overlap and this makes it easier to solder. Further, since the recesses 216 are formed in the free end portion of the terminal 216 of each contact segment on both sides thereof, the contact segment is protected and, by numbering the terminals of the contact segments, it is easy to solder leads to the terminals and checking of the switch can be easily accomplished even if the number of contact segments used is very large.

Figure 18:
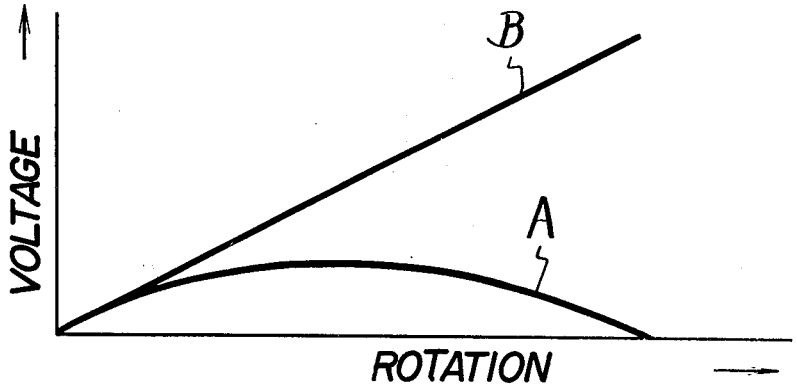
FIG. 18 is a graph showing a comparision of a voltage drop between the first and fourth embodiments.
Figure 16:
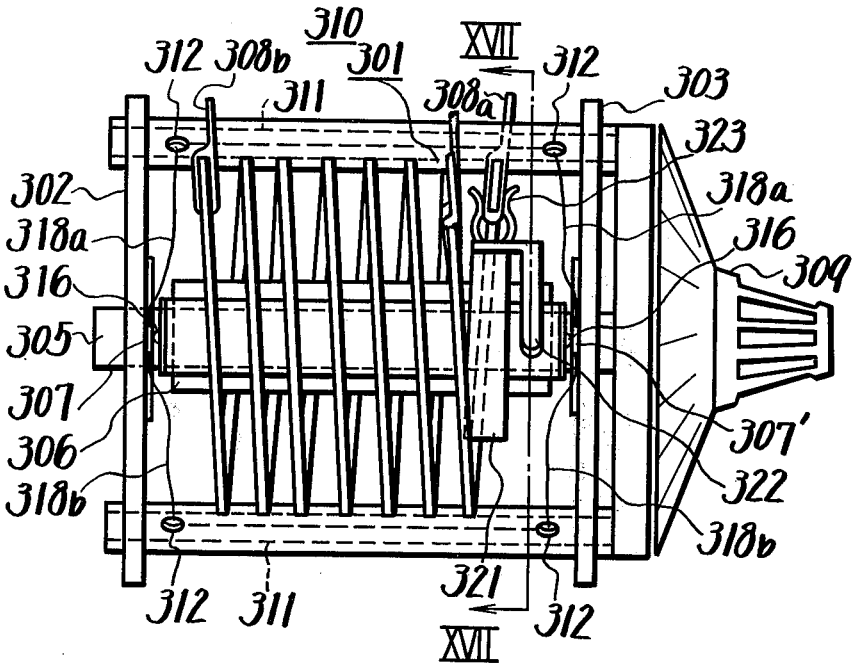
FIG. 16 is a schematic side view of a fourth embodiment of the invention.
Figure 17:
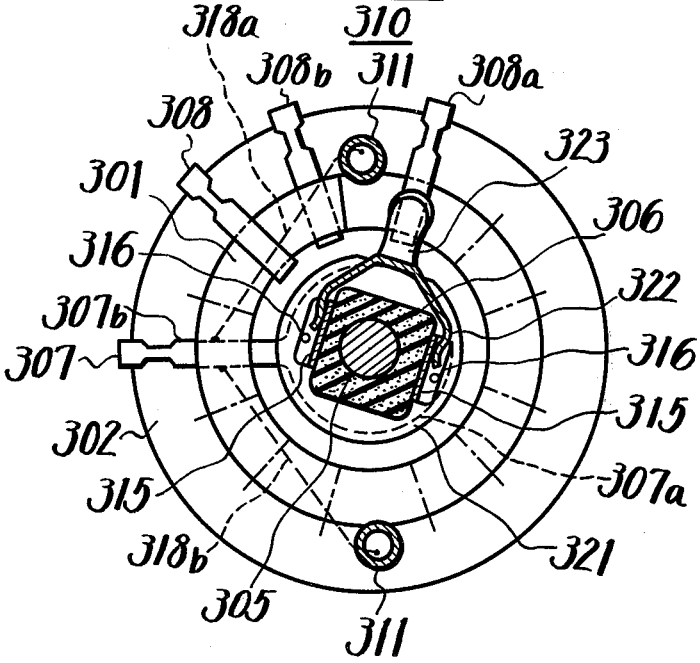
FIG. 17 is a cross-sectional view taken on the line XVII — XVII in FIG. 16.

Turning now to FIGS. 16 to 18, a fourth embodiment of this invention will hereinbelow be described. In FIG. 16, discloses a helical rotary switch 310 which is the fourth embodiment of this invention. The helical rotary switch of this example comprises a spiral-shaped coil 301, a shaft 305, panels 302 and 303 which support both ends of the shaft 305, a terminal plate 307, contact segments (for example, 308*a*, 308*b*), a dial 309, a pair of hollow pipes 311, etc. in substantially the same manner as in the FIG. 1 embodiment. The spiral-shaped coil 301 is supported by the hollow pipes 311 at its diametrically opposite peripheral portions and the hollow pipes 311 are secured at both ends to the panels 302 and 303 respectively. These hollow pipes 311 are insulated or non-magnetic pipes and each have two bores 312 at symmetrical positions near the panels 302 and 303 through with leads may pass. The shaft 305 is supported at the centers of the panels 302 and 303 and carries the dial 309 at the end on the side of the panel 302.

Further, as shown in FIGS. 16 and 17, both end portions of conductive plates 315 which are deposited on a pair of opposing sides of an insulating guide 306 covering the shaft 306 are bent at right angles and projections 316 are formed at the bent portions respectively.

On the opposing sides of the panels 302 and 303, there are bonded by an adhesive or the like terminal plates 307 and 307′ coaxially with the shaft 305. The projections 316 of the conductive plates 315 are held in sliding contact with the terminal plates 307 and 307′ electrically and mechanically. The terminal plates 307 and 307′ are each provided in such a form that a terminal portion 307*b* is formed to extend from an annular plate 307*a*, and the outer and inner diameters of the annular plate 307*a* are selected such that the radius in which the projection 316 of the conductive plate 315 is deposited on the shaft 305 makes sliding contact with the terminal plate 307. In this case, in order to facilitate the electrical connection between the terminal plates 307 and 307′ and the projections 316 of the conductive plates 315, the end portions of the conductive plates 315 having the projections 316 are made resilient.

Leads 318*a* and 318*b* are inserted into the hollow pipes 311. The leads 318*a* and 318*b* are insulating leads whose cores are formed with many copper stranded wires, and both ends of each of the leads drawn out from the aforesaid bores 312 are connected to the terminal plates 307 and 307′, respectively, thereby to provide closed loops via; the terminal plate 307 — the lead 318*a* — the terminal plate 307′ — the conductive plate 315 and the terminal plate 307 — the lead 318*b* — the terminal plate 307′ — the conductive plate 315 and the terminal plate 307.

Further, as illustrated in FIG. 17, an insulating sliding member 321 which is slidable on the insulating guide 306 in its axial direction is provided and a pair of sliding contacts 322 and a pair of resilient contacts 323 are secured to the sliding member 321. The sliding contacts 322 and the resilient contacts 323 are formed of a unitary resilient thin plate. The sliding contacts 322 are electrically connected with the conductive plates 315 of the shaft 305 and the resilient contacts 323 are sequentially moved into sliding contact with the contact segments 308 mounted on the spiral-shaped coil 301 radially thereof. The switching operation of the helical rotary switch of this embodiment is identical with that of the first embodiment and hence will not be described.

As described above, in the fourth embodiment, since the terminal plates 307 and 307′ are provided on the panels 302 and 303, respectively, and are short-circuited through the leads 318*a* and 318*b*, it will be understood that the resistance value between the terminal plate 307 or 307′ and each contact segment 308 can be very low. FIG. 18 is a graph showing a comparison between the voltage drop in the first embodiment and in the fourth embodiment. Reference characeters A and B indicate the cases of the first and fourth embodiments, respectively.

In accordance with the fourth embodiment, the leads 318*a* and 318*b* are disposed in the insulating or non-magnetic pipes, so that no current flows in the leads 318*a* and 318*b* and external induction is also prevented. Thus, the coefficient of induction of the helical rotary switch of the invention is very low.

Although two leads are connected between the terminal plates 307 and 307′ in the above fourth embodiment, no limitation is imposed on the number of leads.

Thus, this invention is of great utility and is of simple construction.

It will be apparent that many modifications and variations may be effected without departing from the scope of the novel concepts of this invention.

I claim as my invention:

1. A helical rotary switch comprising:

a. a spiral-shaped helical coil made of insulating material;

b. a plurality of contacts attached to said helical coil;

c. a rotary contact which engages with said helical coil;

d. a slide member to which said rotary contact is attached;

e. a shaft on which said slide member is slidably mounted;

f. a conductor attached to said shaft and said rotary contact electrically contacting with said conductor;

g. a terminal slidably attached one end of said conductor;

h. a frame member rotatably supporting said shaft; and i. a second means supporting said helical coil from said frame member, said slide member being so mounted on said shaft that when said shaft is rotated, said slide member is rotated and also moved on said shaft in its axial direction with said rotary contact in electrical contact with said conductor and said rotary contact attached to said slide member and guided by said helical coil and said contacts and said contacts successively electrically connected to said terminal through said conductor and said rotary contact.

2. A helical rotary switch as claimed in claim 1, in which said helical coil consists of a plurality of annular units which are connected with one another to form said helical coil.

3. A helical rotary switch as claimed in claim 1, in which said helical coil is so formed that its diameter increases gradually along the axis of said shaft to make said helical coil as a conical shape one.

4. A helical rotary switch as claimed in claim 3; in which said rotary contact of said slide member are so formed that they engage all of said plurality of contacts attached to said helical coil having a conical shape when said shaft is rotated.

5. A helical rotary switch as claimed in claim 1, in which said second means for supporting said helical coil is a tube through which a lead wire is located.

6. A helical rotary switch as claimed in claim 5, in which said tube is made of an insulating material.

7. A helical rotary switch as claimed in claim 5, in which said tube is made of a non-magnetic material.

8. A helical rotary switch as claimed in claim 1, in which a guide made of an insulating material is attached to said shaft to surround said shaft and a conductive plate is attached to said guide along said shaft, and said rotary contact pieces of said slide member in slidably contract with said conductive plate.

9. A helical rotary switch as claimed in claim 8, in which a contact piece is attached to said conductive plate and a terminal plate is attached to said second means for supporting said helical coil, and said contact piece attached to said conductive plate and in contact with said terminal plate.

* * * * *